US005427542A

United States Patent [19]

Gerow

[11] Patent Number: 5,427,542

[45] Date of Patent: Jun. 27, 1995

[54] BREAKAWAY CONNECTOR

[75] Inventor: John B. Gerow, Oshawa, Canada

[73] Assignee: ITT Corporation, New York, N.Y.

[21] Appl. No.: 151,698

[22] Filed: Nov. 15, 1993

[51] Int. Cl.[6] ..... H01R 4/54; H01R 13/514

[52] U.S. Cl. ..... 439/314; 29/876; 439/474

[58] Field of Search ..... 439/474, 475, 314; 29/876

[56] References Cited

U.S. PATENT DOCUMENTS

| | | | |
|---|---|---|---|
| 1,605,904 | 11/1926 | Van Brunt | 439/474 |
| 2,703,870 | 3/1955 | Minto | 439/274 X |
| 3,281,558 | 10/1966 | Weber | 439/651 X |
| 3,649,956 | 3/1972 | Vrobel | 439/598 X |
| 3,688,244 | 8/1972 | Savoca et al. | 439/651 X |
| 3,721,943 | 3/1973 | Curr | 439/275 |
| 3,933,404 | 1/1976 | Oehlerking et al. | 439/474 X |
| 3,976,347 | 8/1976 | Cooke, Sr. et al. | 439/475 X |
| 4,077,690 | 3/1978 | Koether | 439/474 X |
| 4,166,664 | 9/1979 | Herrmann, Jr. | 439/475 X |
| 4,522,458 | 6/1985 | Werth et al. | 439/475 X |
| 4,653,839 | 3/1987 | Powell | 439/650 |
| 4,702,537 | 10/1987 | Mattingly et al. | 439/314 X |
| 4,707,046 | 11/1987 | Strand | 439/314 |
| 4,904,208 | 2/1990 | Powell et al. | 439/654 |
| 4,909,761 | 3/1990 | Miguira | 439/662 |

*Primary Examiner*—Z. R. Bilinsky
*Attorney, Agent, or Firm*—Thomas L. Peterson

[57] ABSTRACT

A connector is described that allows the connector main part (16, FIG. 2) to be pulled out of a coupling nut or part (24) when the cable (20) that extends rearwardly from the main part, is pulled with a large force. The main part is of the type that includes a metal shell (30) enclosing an insulator (32) that holds contacts (34) whose front ends mate with the contacts of a mating connector device (14) and whose rear ends connect to wires of the cable. The outside of the shell and the inside of the coupling part have adjacent grooves (56, 54), and an expandable ring-shaped retainer (52) lies in both grooves to normally hold the main part to the coupling part. The forward wall (74, FIG. 3) of the groove in the main part is inclined from an axial direction to form a ramp. If the main part is pulled rearwardly with a large force, the retainer expands as it rides up the ramp and past the front of the main part, to thereby release the main part from the coupling part and the connector device to which it is coupled.

5 Claims, 2 Drawing Sheets

BREAKAWAY CONNECTOR

BACKGROUND OF THE INVENTION

A common type of connector includes a main part comprising a shell, an insulator within the shell, and contacts within the insulator. The front ends of the contact mate with contacts of a mating connector device, while the rear ends of the contacts are connected to wires of a cable that extends rearwardly from the main part. A coupling nut extends around the front end of the shell and secures the main part to the mating connector device, to assure proper mating and to prevent the connector and connector device from separating. In some applications, the cable may be pulled with a force that is large enough to tear it loose from the connector, while possibly tearing out parts of the connector such as the contacts from the insulator. Among actual incidents involving seismic connectors, is one wherein a truck driver drove off with the cable attached to the truck and tore the cable out of the connector, and another incident where a cable extended across a road and became caught on a passing vehicle which tore it out of the connector.

Breakaway devices have been known in the past, but applicant does not know of any breakaway connector. U.S. Pat. No. 4,909,761 describes a breakaway fuse holder wherein a nut has a rear end threadably mounted on one part and a front portion forming fingers with front ends received in a groove of a second part. When the parts are pulled apart with sufficient force, the fingers deflect radially out of the groove to release the parts. Such a construction results in the nut having slots between the fingers, which is often unacceptable in electrical connectors because electromagnetic energy may pass through such slots to interfere with signals passing between the contacts. Also, the cost of the nut would be relatively high because of the need to machine it with fingers that will breakaway at a predetermined force level. A breakaway connector of the type that includes a plurality of signal-carrying contacts, which retained the EMI (electromagnetic interference) shielding of a coupling nut or part while enabling breakaway at a predetermined force level in a construction of only moderate cost, would be of value.

SUMMARY OF THE INVENTION

In accordance with one embodiment of the present invention, a breakaway connector is provided, of the type that includes a coupling nut or part that surrounds the front of the connector main part, which enables the main part to be pulled out of the coupling part at a given pulling force, in a relatively simple and reliable construction. A separate retainer is engaged with force-transmitting surface regions of both a shell of the connector main part and the coupling part. The retainer is deflectable to release from one of the parts when the main part is pulled rearwardly with a large force. The use of a separate retainer allows the coupling part to be free of a plurality of slots through which EMI might pass, and allows the coupling part to be constructed at low cost. The separate retainer can be constructed at low cost and can be constructed to permit release at close to a predetermined pulling force on the main part.

In one connector, the retainer is in the form of an expandable ring. The shell has an external groove while the coupling part has an internal groove, with the grooves lying adjacent to each other and with the retainer lying in both grooves. The forward end of the shell groove is tapered to form a ramp. When the main part is pulled rearwardly, a shoulder formed at the groove of the coupling part pushes the retainer forwardly and causes it to expand radially while riding up the ramp, and then to slide along the front end of the shell and off the shell to thereby free the main part to move rearwardly.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
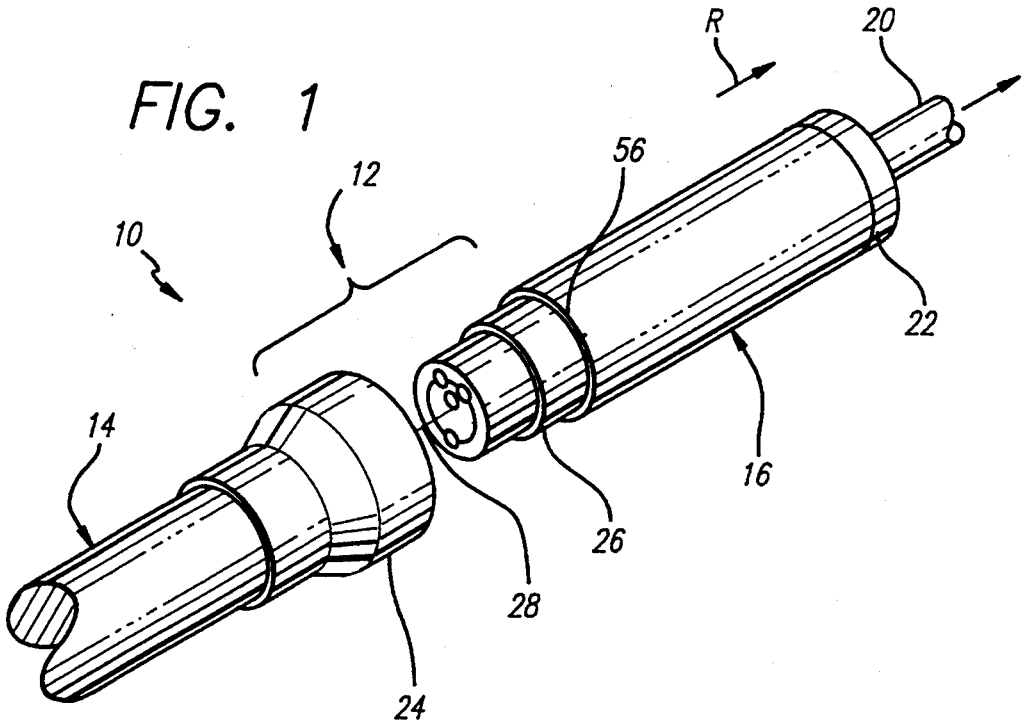
FIG. 1 is an isometric view showing a connector and mating connector device, wherein the main part of the connector has pulled out of engagement with the coupling part of the connector.

FIG. 1 illustrates a connector system 10 which includes a breakaway connector 12 that can mate to a mating connector device 14. The connector 12 includes a main part 16 which has contacts connected to wires of a cable 20 extending in a rearward direction R from the rear end 22 of the main part. The connector also includes a coupling nut or coupling part 24 which is normally attached to the front portion or front end 26 of the main part. FIG. 1 shows the main part 16 having been separated from the coupling part and moving rearwardly along the axis 28 of the connector.

Figure 2:
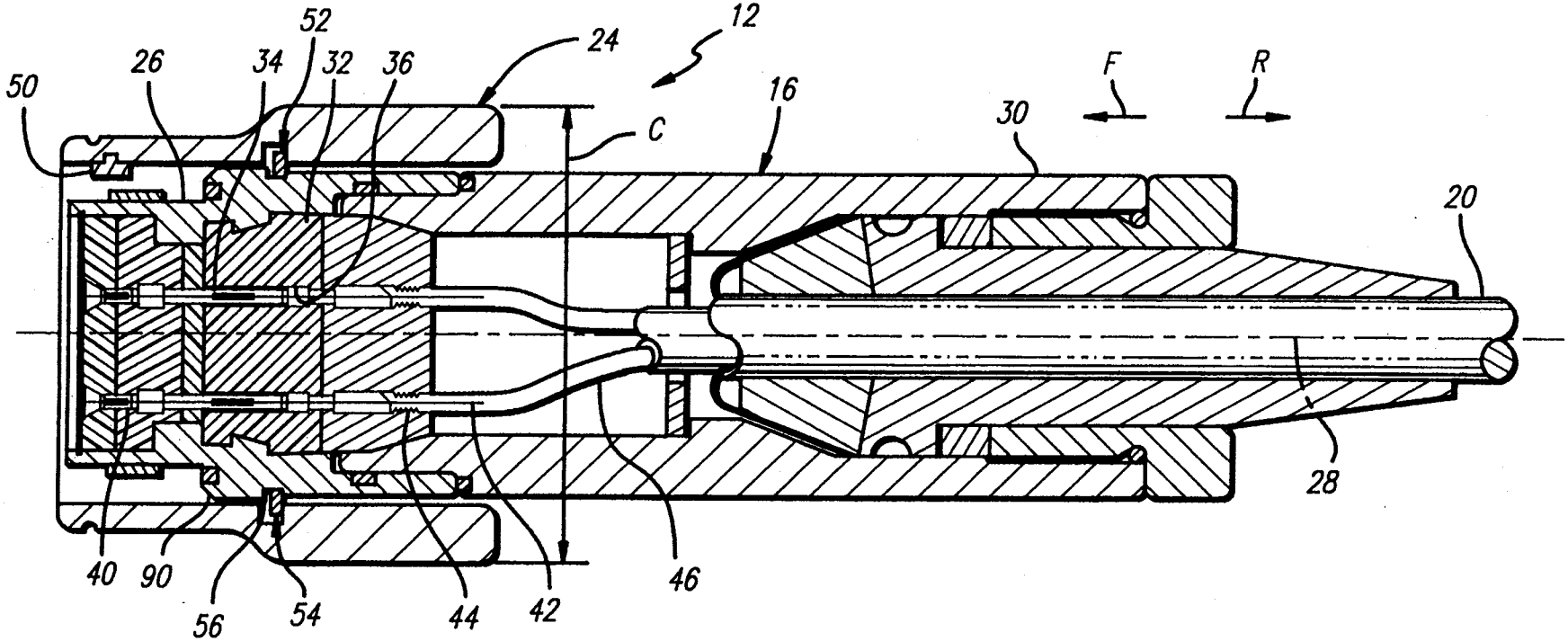
FIG. 2 is a sectional view of the connector of FIG. 1 in its assembled position.

FIG. 2 shows details of the breakaway connector 12. The main part 16 includes a shell 30, an insulator 32 lying within the shell, and a plurality of contacts 34 lying in passages 36 of the insulator. Each contact has a front end 40 which is designed to mate with a corresponding contact of the mating connector device. Each contact also has a rear end 42 which is usually permanently connected to a conductor 44 of a wire 46. The wires 46 are part of the cable 20 that extends rearwardly from the connector. The particular connector shown is a seismic type which has sixteen contacts 34, with perhaps three of them used to carry power (plus, minus, and ground) and with the rest constructed to carry signals, that is, electrical currents whose variation represents data.

The connector 12 is used by connecting the front end 26 to the front end of the mating connector device. The coupling part 24 securely joins to the mating connector device by a bayonet roller 50 on the coupling part engaging a thread or groove on the mating connector device to prevent them from separating until the coupling part 24 is turned. The coupling part 24 is retained on the main part 16 by a retainer 52 that lies in grooves 54, 56 of the parts. Each groove 54, 56 is annular, and extends more than 180° and preferably about 360° around the connector axis. In the prior art, a retainer very securely held the coupling and main parts together. If a large rearward force were applied to the cable 20, such a force could cause breakage of the cable, the tearing loose of the cable and its wires from the main part 16, or the tearing out or breakage of the mating connector device. The resulting damage generally could not be repaired in the field.

In accordance the present invention, applicant constructs the connector so the retainer 52 allows the main part 16 to move rearwardly and break away from the coupling part 24, at a predetermined breakaway force. The breakaway force is set so it is considerably less than the maximum safe pull force that can be applied to the cable 20 without danger of breaking the cable or tearing it loose from the main part 16 of the connector. It is noted that only a moderate force is required to demate the contact front ends 40 from corresponding contacts of the mating coupling device, so such demating force adds only a small amount to the force required to release the retainer 52, in order to pull out the connector main part 16. The retainer 52 is constructed so it is deflectable to release the parts, with the deflection preferably being resilient so the release does not damage the retainer 52. This allows the main part 16 to be reinstalled in the coupling part 24.

Figure 3:
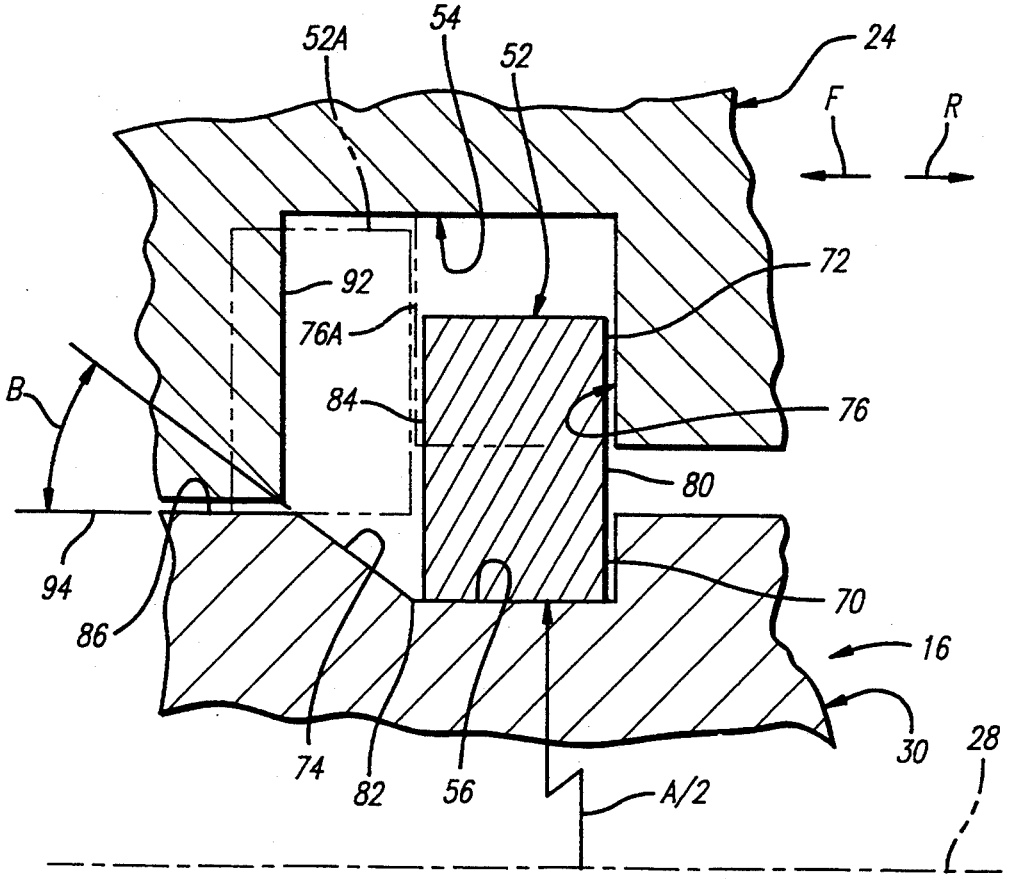
FIG. 3 is an enlarged view of a portion of the connector of FIG. 2.
Figure 4:
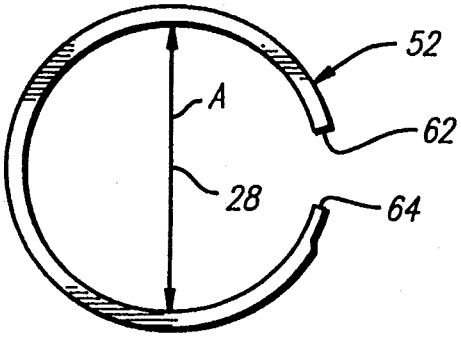
FIG. 4 is a front elevation view of the retainer of the connector of FIG. 2.

FIG. 3 shows details of the retainer 52 and of adjacent portions of the walls of the grooves in the coupling part 24 and shell 30. The retainer 52 is preferably in the form of a ring that can expand in diameter, such as the ring shown in FIG. 4 which extends by much more than 180° about the axis 28 of the connector, but which has opposite ends 62, 64 that can separate to expand the internal diameter A of the ring. Referring again to FIG. 3, it can be seen that the retainer or retainer ring 52 has radially inner and outer parts 70, 72 that lie respectively in the external groove 56 of the shell and in the internal groove 54 of the coupling part. The walls of the shell groove 56 include a forward portion 74 that is angled from the axis 28 to extend radially outwardly and forwardly, that is, so locations progressively or forward in direction F lie further from the axis 28. The tapered forward portion 74 forms a force-transmitting surface region or angled shoulder which faces partially in a rearward direction and resists forward movement of the retainer ring 52 (with respect to the shell 30), to normally keep the retainer ring 52 in place. The coupling part 24 has a force transmitting surface region 76 forming a forwardly-facing shoulder that abuts a rear face 80 of the retainer ring to prevent the ring from moving rearwardly.

If a large rearward force is applied to the shell 30, or if a large forward force is applied to the coupling part 24, the shoulder 76 presses the retainer ring forwardly. This causes the radially inner edge 82 of the retainer ring forward face 84 to "ride" up the ramp formed by the tapered surface region 74. The retainer ring expands in diameter, until, at the position shown at 52A the retainer ring has passed beyond the ramp at 74 to lie on the cylindrical surface 86 that extends forwardly of the ramp. The shoulder 76 has moved to the position 76A, and continues to press the retainer ring 52A forwardly. The retainer ring encounters only friction against surface 86 until it falls off the front end 26 (FIG. 1) of the connector main part 16 and shell.

After the main part has been pulled completely out of the coupling part 24, the retainer ring 52 remains in the groove 54 of the coupling part. The main part can be reinstalled in the field, by merely pressing the main part 16 in the forward direction F until a tapered surface 90 engages the retainer ring and expands it until the ring reaches the external groove 56 in the shell 30 of the main part. During such installation, a forward shoulder 92 formed by the internal groove 54 in the coupling part presses the retainer ring rearwardly.

The force required to expand the retainer ring 52 depends upon the construction of the retainer ring, and on the angle B of the surface region 74, as seen in a sectional view taken on the axis 28, with respect to a line 94 that is parallel to the axis. Applicant prefers that the angle B be less than 60°, and more preferably less than 45°. This minimizes tipping of the retainer ring wherein its radially outer part 72 moves forwardly more than its radially inner part 70, and also minimizes the possibility that friction at the ring inner edge 82 will cause it to bind on the ramp 74 and prevent the ring from expanding. The particular angle B is 30°. The angle can be reduced to reduce the axial force required to pull out the connector main part.

In one connector for seismic applications that applicant has designed, the coupling nut or part 24 had an outside diameter C of 1.725 inch, with the other dimensions relative to dimensions C being as shown in the drawings. It was found that the cable 20 would pull out of the connector main part 16 at a pulling force of about 230 pounds. A safe pull force was determined to be about one third of this, or about 85 pounds. The force required just to unmate the contact front ends 40 from the corresponding contacts of the mating connector device, is about 10 pounds. Thus, the ring 52 and shell surface region 74 were constructed to allow the release ring to expand and move up the ramp at 74 when the ring was pressed forwardly by a force of about 75 pounds. Of course, the actual force varies depending upon the coefficient of friction of the surface region 74 and of the ring inner edge at 82, which may depend upon the surface finish, any oil or moisture remaining on the surfaces, etc. However, the force for expansion of the ring can be predicted within moderate tolerances, such as between perhaps 60 pounds and 90 pounds, which is sufficient to assure that the connector main part will break away at a force much less than that which would damage the connection of the cable to the main connector part.

A variety of retainer constructions are available. For example, Smalley Steel Ring Company of Wheeling, Ill. offers a variety of retaining metal rings including those wherein the metal extends in a tight spiral of two complete turns with free ends. The ring can be made of a thin plastic material that will break at a predetermined force, although this makes initial installation and reinstallation difficult. A retainer can be in the form of compressible blocks instead of a continuous ring. A ring-shaped retainer could have a tapered end to ride out of a groove which does not have a ramp. The shell and coupling part can be formed respectively with a ramp and shoulder that do not form part of a groove. In any case, the use of a retainer which is separate from the shell 30 of the connector main part and from the coupling part 24, enables the shell and coupling part to be constructed at moderate cost (and without slots that leak electromagnetic energy), while enabling release to be relatively accurately controlled by the use of a separate release member that can be constructed at low cost.

Thus, the invention provides a breakaway connector which allows the connector main part to be pulled rearwardly out of the coupling nut or part, in a low cost and dependable construction. The connector main part and coupling part have adjacent force-transmitting surface regions that are both engaged with a retainer, at least when the connector main part is pulled rearwardly. The retainer is deflectable to release from one of the parts when the main part is pulled rearwardly, to allow the main part to move rearwardly out of engagement with the coupling part. The retainer is preferably a ring which is expandable in diameter and which has radially inner and outer parts lying in grooves of the main part and coupling part. The walls of one of the grooves such as the external groove in the main part, is tapered in a forwardly and radially outward direction so the retainer ring expands in diameter as it moves along the tapered surface to provide a largely predictable resistance to such expansion and movement.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A breakaway connector which has an axis and which comprises a main part that includes a shell with an outside surface, an insulator in the shell, a plurality of contacts in the insulator and a cable extending rearwardly from the insulator and having a plurality of conductors connected to said contacts, wherein the connector also includes a coupling part for coupling to a mating connector device, wherein of said connector and said connector device one has pin contact ends that mate with socket contact ends of the other, with said coupling part surrounding the shell and having an internal surface, and wherein said cable can be pulled rearwardly with respect to said said shell has an external groove in its outside surface which extends by more than 180° about said axis, and said coupling part has an internal groove in its internal surface which extends by more than 180° about said axis, with said grooves lying opposite each other; and a ring-shaped retainer which has radially inner and outer parts lying respectively in said external and internal grooves, with the walls of said groove of said shell forming a ramp that is angled from said axis to extend radially outward and forwardly and with the walls of the groove of said coupling part constructed to abut said retainer and prevent the retainer from sliding axially thereon, so said retainer deforms to ride out of said groove of said shell while remaining in said internal groove, and said contacts unmate, when a predetermined rearward release force is applied by said cable to said main part which is no more than said predetermined safe force level, when said contacts ends of said connector are mated to said contacts ends of said connector device.

2. The connector described in claim 1 wherein:

said ramp extends at an angle B of no more than 45° from said axis.

3. The connector described in claim 1 wherein:

said ramp extends at an angle B of about 30° from said axis.

4. A method for releasing a front end of a connector main part which has an axis and which includes a shell surrounding a contact-holding insulator, from a coupling part, wherein the coupling part has an inside surface and the shell has an outside surface lying within said inside surface, comprising:

forming said shell outside surface with an external groove having forward and rearward walls, with said forward wall comprising a ramp wall which extends at a forward and radially outward incline to said axis, and with a forward surface region lying forward of said ramp which is of substantially no greater diameter than the forward end of said ramp;

forming said coupling part inside surface with an internal groove having forward and rearward walls;

installing an expandable retainer ring and inserting said shell into said coupling part around said shell so a portion of said retainer ring lies in said external groove of said shell and another portion of said ring lies in said internal groove of said coupling part, including forming said ramp wall at a large enough angle to said axial direction so when said shoulder pushes said retainer ring forwardly said ring moves forwardly along said ramp while progressively increasing in diameter until it lies and moves forwardly along said forward surface region and then forwardly off said shell while remaining trapped within said internal groove.

5. The method described in claim 4 wherein:

said step of forming said ramp includes forming it at an angle B to the said axis, which is no more than 45°.

* * * * *